US006116574A

United States Patent [19]

Petersen

[11] Patent Number: 6,116,574

[45] Date of Patent: Sep. 12, 2000

[54] EXPANSION VALVE

[75] Inventor: Hans Kurt Petersen, Nordborg, Denmark

[73] Assignee: Danfoss A/S, Nordborg, Germany

[21] Appl. No.: 09/352,438

[22] Filed: Jul. 13, 1999

[30] Foreign Application Priority Data

Aug. 19, 1998 [DE] Germany ..... 198 37 556

[51] Int. Cl.[7] ..... F25B 41/04

[52] U.S. Cl. ..... 251/282; 62/324.6; 236/92 B

[58] Field of Search ..... 62/225, 324.6; 236/92 B; 251/282

[56] References Cited

U.S. PATENT DOCUMENTS

| | | | |
|---|---|---|---|
| 3,738,573 | 6/1973 | Eschbaugh et al. | 251/282 |
| 3,967,782 | 7/1976 | Eschbaugh et al. | 251/282 |
| 4,618,092 | 10/1986 | Fukushima et al. | 251/282 |
| 4,750,334 | 6/1988 | Leimbach | 251/282 |
| 4,852,364 | 8/1989 | Seener et al. | 251/282 |

*Primary Examiner*—William E. Tapolcai
*Attorney, Agent, or Firm*—Lee, Mann, Smith, McWilliams, Sweeney & Ohlson

[57] ABSTRACT

An expansion valve having a valve element, which valve element co-operates with a valve seat arranged between a first port and a second port in a housing, and is movable by an operating device in one direction and by a restoring device in the opposite direction along the same axis relative to the valve seat. It is desirable to make the properties independent of the operating direction in which the refrigerant flows. For that purpose, the valve element is connected to a first pressure surface arrangement, which comprises first pressure surfaces of substantially equal size acting in opposite directions, on which the pressure in the first port acts when the valve is closed, and to a second pressure surface arrangement, which comprises second pressure surfaces of substantially equal size acting in opposite directions, on which the pressure in the second port acts when the valve is closed.

28 Claims, 3 Drawing Sheets

EXPANSION VALVE

The invention relates to an expansion valve having a valve element, which valve element co-operates with a valve seat arranged between a first port and a second port in a housing, and is movable by an operating device in one direction and by a restoring device in the opposite direction along the same axis relative to the valve seat.

An expansion valve of that kind is known from the Aug. 10, 1995 edition of the Danfoss A/S company publication "Thermostatic expansion valve TDE with fixed orifice".

A thermostatic expansion valve of that kind is used to inject a coolant into an evaporator, to be precise, generally in dependence on superheating of the coolant. There are various options for the control or regulating philosophies. In the case of the expansion valve known from the said company publication, the opening of the expansion valve is adjusted so that superheating of the coolant remains more or less constant.

Some systems are used in summertime operation so that heat is conveyed from the interior of a building or room to the outside. In so-called winter operation, the system is operated in reverse, that is, heat is conveyed inwards from the outside.

Originally, two expansion valves connected antiparallel were used for that purpose. That solution is relatively complicated, however, and forces up the costs. In the above-mentioned company publication, it was therefore proposed to use just one expansion valve, operable in both directions. It is a disadvantage here, however, that the static superheating of the evaporator is different in the two forms of use. This is attributable, for example, to the fact that when refrigerant flows through the valve in one direction, the pressure of the refrigerant in the opening direction acts on the valve, whereas this pressure is not available when refrigerant flows through in the opposite direction. The pressure even leads to a more forceful closure of the valve element. This can have a negative effect on the efficiency and on the capacity of the system.

The invention is based on the problem of making certain properties independent of the operating direction of the expansion valve.

That problem is solved in the case of an expansion valve of the kind mentioned in the introduction in that the valve element is connected to a first pressure surface arrangement, which comprises first pressure surfaces of substantially equal size acting in opposite directions, on which the pressure in the first port acts when the valve is closed, and to a second pressure surface arrangement, which comprises second pressure surfaces of substantially equal size acting in opposite directions, on which the pressure in the second port acts when the valve is closed.

With this configuration, the valve element is relieved of pressure from both ports with respect to refrigerant pressure, so that the valve element is acted upon in terms of force almost exclusively by the operating device and by the restoring device. The operating device need therefore only apply forces sufficient to overcome the counter-forces of the restoring device. Otherwise, the valve element is in equilibrium. The pressure in the first port acts on a first pressure surface, and consequently attempts to lift the valve element from the valve seat and open the valve, but at the same time the pressure in the first port acts on a first pressure surface in an opposite direction of action, that is to say, the pressure acting on this pressure surface attempts to move the valve element in the closing direction and to close the valve or hold it closed. Accordingly, the pressure in the first port acts with the same force in opposite directions. It accordingly has no influence on the opening characteristic of the valve, that is, in the lifting of the valve element from the valve seat. Similarly, the pressure in the second port acts on the one hand on a second pressure surface and attempts to lift the valve element away from the valve seat, but at the same time the pressure in the second port is still also acting on another second pressure surface, attempting to press the valve element on to the valve seat again. The valve element is consequently in equilibrium in respect of the pressure in the first and second ports. This state of equilibrium is relevant not only when the valve is closed, but also when the valve element is lifted away from the valve seat. Explanation is simpler for the closed state, however.

The valve element is preferably connected to a slide member that is guided parallel to the axis. This is therefore a simple way of permitting a reciprocating movement of the valve element, which ensures that the valve element is always correctly aligned relative to the valve seat.

The first pressure surface arrangement and the second pressure surface arrangement are advantageously separated from one another by a piston guided in a sealed manner, wherein, on movement of the valve element, a relative movement between the piston and a complementary sealing face is effected. By means of the piston, or more accurately, by means of the sealing zone formed by the piston and the complementary sealing face, a separation in respect of pressure is achieved between the first and the second port. The function of the valve is thus on the one hand maintained, which is intended to create or maintain a certain pressure relation between the two ports; and on the other hand, it is ensured that the pressure of the respective ports is able to reach the pressure surfaces of the two pressure surface arrangements. Because the sealing zone is movable, the seal is preserved even when the valve element performs an opening or closing movement.

This arrangement also enables the slide member to be constructed without a seal relative to the valve housing, so that it is possible for a pressure-equalising channel or path to form between these two parts. This enables the pressure to pass from one port, past the slide member, to the other side and to relieve the slide member of stress from that side. The slide member can even be guided with clearance in the housing.

The piston advantageously has secured to it a seal, which lies against the complementary sealing face. The seal can then be of relatively simple construction, because it surrounds the piston circumferentially. Such piston seals are known per se from other applications.

It is especially preferred for the seal to be in the form of a piston ring arrangement. A piston ring arrangement surrounds the piston annularly. It is simple to install and is highly reliable in operation.

The piston ring arrangement preferably has at least one radially outwardly pre-tensioned sealing lip. The sealing lip forms the contact with the complementary sealing face and ensures that no pressure is able to pass from one port to the other at the sealing arrangement.

It is especially preferred for the piston ring arrangement to have two oppositely directed sealing lips. This assures the seal relative to the complementary sealing face in both directions of movement of the piston.

It is especially preferred for the sealing lips to be arranged on two lipped rings that are identical but installed with a different direction. This simplifies construction, because only a single type of lipped ring needs to be kept in stock. The sealing lips can be formed from a material that co-operates with the complementary sealing face with low friction. Plastics materials such as polytetrafluoroethylene (PTFE), for example, Teflon, can be considered.

The lipped rings preferably have radial supporting surfaces. The radial supporting surfaces are able to absorb lateral forces, so that even under load the sealing lips are protected.

It is especially preferred in this connection for the supporting surfaces to be formed on rings, on the end faces of which the lipped rings lie superimposed on one another. The rings accordingly have a dual function. They stabilise the two lipped rings both in an axial direction and in a radial direction.

Together with the piston, the sealing lips preferably form annular pockets, which are open in the direction of movement. A pressure that builds up in front of the piston in the direction of movement then causes the sealing lips to be pressed with greater force against the complementary sealing face. This improves the sealing properties, which is exactly what is wanted in the case of higher pressures.

Advantageously, the piston ring arrangement is supported by a retaining disc. The piston ring arrangement can be supported without difficulty against the piston axially, for example, against a circumferential projection, but in the other direction the corresponding support becomes difficult if it is desired to use undue expansion of the piston ring arrangement during assembly. A supporting disc provides a good alternative here. The supporting disc can be put in place after the piston ring arrangement has been pushed onto the piston and then holds the piston ring arrangement fixedly. Furthermore, it supports the piston ring arrangement, that is, it is able to project radially a little way beyond the relevant supporting surface on the piston. A retaining disc of this kind can consist of metal, for example, stainless steel.

The piston ring arrangement can also comprises a piston ring divided circumferentially, which preferably expands radially under pressure. Since it has overlapping ends circumferentially, a closed seal is achieved circumferentially.

The slide member is advantageously guided in the housing so as to form a pressure equalization path, which connects to the second port. The pressure equalization path allows the pressure in the second port to get past the slide member onto the other side and hence relieve the slide member of stress from this other side. In this way, pressure equalization for the second port can be provided via the slide member, with no need for additional channels in the housing. The pressure equalization path can be formed, for example, by guiding the slide member in the housing with a certain clearance. Alternatively, it can be formed by flattening the slide member at one or more locations circumferentially. Finally, axially running recesses can also be provided on the surface of the slide member. All these measures can be accomplished relatively easily on the slide member. Corresponding machining of the housing would also be possible, but would require greater effort in manufacture. Nevertheless, machining of the housing bore, which receives the slide member, is still far simpler than providing separate channels.

The piston is preferably arranged fixedly in the housing and projects into the slide member, the piston defining in the slide member a pressure chamber, which connects with the first port when the valve is closed. The cross-sectional area of the pressure chamber corresponds to the cross-sectional area of the valve seat. If the pressure in the first port now acts on the valve element, then it also acts in the opposite direction on the corresponding end face of the pressure chamber. The pressure in the first port is not able to propagate further, however, because it is held back in the pressure chamber by the piston with the sealing arrangement. The pressure in the second port acts similarly, however, also on two end faces of the slide member, so that the slide member is in complete equilibrium in respect of pressure.

In this case, the piston is preferably supported via an articulation surface arrangement against a shaft. This enables the slide member to be somewhat inclined in the housing, without consequent impairment of the seal associating the piston and slide member. The piston can remain with its axis always parallel to the axis of the slide member. This is especially advantageous when the pressure equalization path is formed by a slide member guided with clearance in the housing.

The connection of the piston with the shaft is preferably able to absorb tensile and compressive forces. Since the pressure is able to advance from the second port past the slide member to the connection point, under adverse circumstances there is a danger that the piston will be lifted by the shaft. This can be prevented by the connection, which absorbs only tensile and compressive forces, but allows a certain mobility for tilting of the piston with respect to the shaft.

In an especially simple construction, the connection can be formed by a spring washer, which is inserted in an annular space that is enclosed by a first annular groove on the piston and a second annular groove on the shaft. If the spring washer has a certain clearance with respect to one of the two annular grooves, this does allows a tilting motion of the piston with respect to the shaft, but a tensile force can be transferred from the piston to the shaft or vice versa, so that the piston is safeguarded against being lifted away from the shaft.

The slide member is advantageously in the form of a cup-shaped bowl, at the closed end of which there is arranged the valve element. The open end of the bowl is consequently available for receiving various functional elements, for example, for receiving the piston. The term "bowl" should not be interpreted, however, to mean that its diameter must be larger than its depth. It is merely a way of expressing that the valve element is hollow and is open in one direction.

A hollow cylinder that together with the piston bounds the pressure chamber is preferably inserted in the bowl. The pressure chamber can then be manufactured very precisely, without the entire slide member having to be manufactured with corresponding accuracy at the same time. The hollow cylinder can also have other material properties, for example, a greater mechanical strength than the slide member, so that the pressures in the pressure chamber do not inevitably result in deformation of the slide member, which could lead to jamming of the slide member in the housing. This construction affords greater freedom in the construction of the slide member.

The outer wall of the hollow cylinder and the inner wall of the bowl advantageously form an annular space, in which a restoring spring is arranged. The hollow cylinder and the slide member then together form a guide for the restoring spring, which similarly increases operational reliability of the expansion valve.

In an alternative construction, the piston is arranged on the slide member and has a channel passing through it parallel to the direction of movement. Pressure, or more accurately, fluid at the corresponding pressure, is able to pass through the channel from one side of the piston to the other and bring about the corresponding pressure equalization.

It is especially preferred in this connection for the piston to be arranged on the other side of the valve seat from the slide member and to be connected with the slide member via a rod. In this arrangement, the piston can be arranged directly adjacent to the actuating device, for example, a diaphragm capsule. The pressure that acts from the first port in the opening direction on the valve element acts in the opposite direction on the piston. Since the piston is connected to the valve element and to the slide member respectively via the rod, the corresponding equilibrium of forces is consequently achieved. The pressure in the second port advances past the slide member "beneath" the slide member, that is, on the side of the slide member remote from the valve element. The pressure in the second port therefore acts on the entire cross-sectional area of the slide member in the closing direction. In the reverse direction, the pressure in the second port acts on an annular region of the slide member that is not covered by the valve seat. The missing surface area is then provided by the other side of the piston. The pressure is able to reach this surface area through the channel that passes through the piston.

In a third alternative, the piston can be arranged on the same side of the valve seat as the slide member and in a guide built into the housing. Exactly as in the first construction, the piston then defines a pressure chamber in which the pressure is the pressure in the first port. For the pressure at the second port, there are two faces on the slide member that are the same size but act in opposite directions.

The valve element is preferably formed in one piece with the slide member. It can be made, for example, from the same material as the slide member and be integrally moulded with the slide member. Alternatively, however, it can consist of a different material and be fixedly connected to the slide member by suitable measures, for example, a flanging over operation.

The invention is described in detail in the following with reference to preferred exemplary embodiments in conjunction with the drawings, in which.

Figure 1:
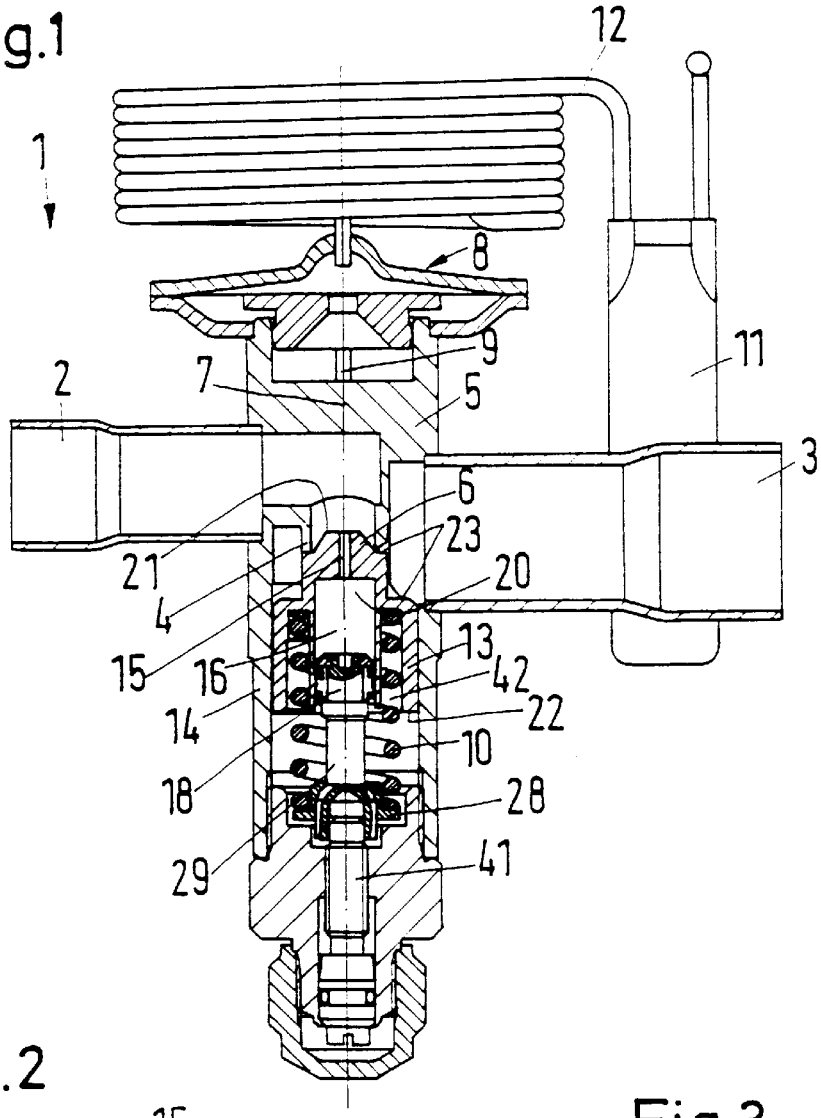
FIG. 1 is a first construction of an expansion valve.

An expansion valve 1 has a first port 2 and a second port 3. A refrigerant can flow either from the first port 2 to the second port 3 or vice versa, from the second port 3 to the first port 2. The flow is controlled here by co-operation of a valve seat 4, which is arranged in the housing 5 of the expansion valve, with a valve element 6. The valve element 6 can be moved along an axis 7 away from the valve seat 4 or towards it. Control of the valve element 6 is effected by means of a bellows element 8 known per se, which acts on the valve element 6 via a tappet 9 located outside the plane of the drawing. A restoring spring 10 is provided to restore the valve element 6 to the valve seat 4. The bellows element 8 is controlled by means of a diagrammatically illustrated temperature sensor 11, which for that purpose is connected via a capillary line 12 to the bellows element 8. It is not absolutely necessary for the temperature sensor 11 to be arranged at the second port 3.

In the present embodiment, the valve element 6 is part of a slide member 13, which is arranged with clearance in a guide 14 built into the housing and is displaceable along the axis 7. The slide member 13 is in this case arranged on the side of the valve seat 4 that connects to the second port 3. Accordingly, the pressure in the second port 3 is able to reach the side of the slide member 13 remote from the valve seat 4.

The valve element 6 has a channel 15 passing through it. The channel 15 passes the pressure in the first port 2 into a pressure chamber 16, which is surrounded circumferentially by a hollow cylinder 17 and at its open end 19 (FIG. 2) is surrounded by a piston 18. With the valve closed, that is, when the valve element 6 lies on the valve seat 4, the pressure in the first port 2 does penetrate into the pressure chamber 16 but, because of the seal provided by the piston 18, the pressure in the first port 2 remains isolated from the pressure in the second port 3. That pressure is found on the other side of the piston. The cross-section of the pressure chamber 16 and hence its end face 20 facing the valve element 6, is the same size as the end face 21 of the valve element 6 surrounded by the valve seat 4. The pressure in the first port 2 accordingly acts from both sides on the valve element 6 and on the slide member 13 connected thereto. In view of these pressure ratios, the slide member 13 is in equilibrium in respect of pressure and force.

The pressure in the second port 3 acts on one side, as stated above, on the "underside" 22 of the slide member 13, in fact on an annular region that is not covered by the piston 18. An annular face 23 of the same size, on which the pressure in the second port 3 also acts, make sure that the slide member 13 is consequently also in force equilibrium in respect of the pressure in the second port 3.

The information that particular oppositely directed faces, on which the pressure in the first port 2 and in the second port 3 respectively acts, are supposed to be the same size does not mean that the equality has to be exactly satisfied in the mathematical sense. Relatively small differences, for example, caused by a finite width of the valve seat 4, are quite acceptable. The extent of equality need only be such that the forces on the slide member 13 caused by the different pressures are very small, so that control of the movement of the slide member 13 is effected virtually exclusively by the bellows element 8 acting as operating device and by the restoring spring 10 acting as restoring device. With this construction, the control characteristic of the expansion valve 1 then becomes independent of the flow direction of the refrigerant. That is, it is no longer important whether the refrigerant flows from the first port 2 to the second port 3 or from the second port 3 to the first port 2. The higher pressure in each case contributes virtually nothing to opening of the valve, that is, to displacement of the slider member 13.

Figure 2:
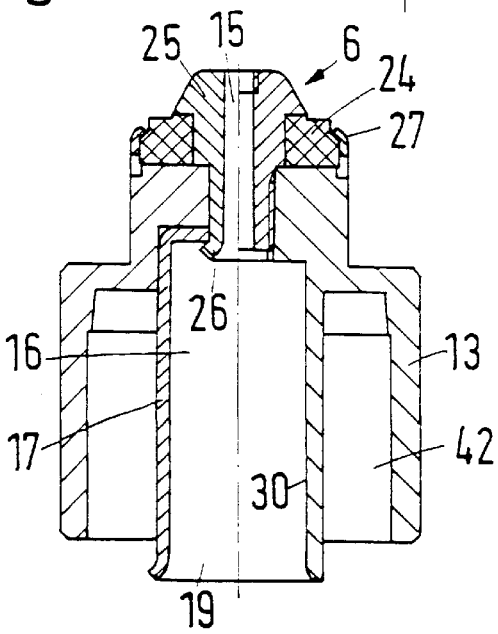
FIG. 2 is an enlarged view of a slide member

FIG. 2 illustrates that the valve element 6 consists of several parts, namely, a sealing ring 24, which is secured to the slide member by means of an insert 25. The insert 25 is bent over at its end 26 remote from the sealing ring 24 and thus at the same time locks the hollow cylinder 17 in place. Similarly, the slide member 13 is bent over at its upper end 27, to lock the sealing ring 24 in place. It is, of course, not only possible to construct the slide member 13 in one piece with the valve element 6, as shown, but also to make them of the same material, so that fixing measures are not needed.

Together with the slide member 13, the hollow cylinder 17 forms an annular space 42, in which the restoring spring 10 is inserted. The restoring spring 10 is thus guided for a certain axial length.

Figure 3:
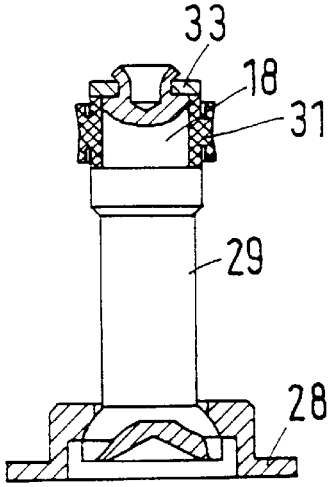
FIG. 3 is an enlarged view of a piston.

The restoring spring 10 is supported (FIG. 3) on a supporting ring 28, which is mounted on a piston carrier 29 which in turn carries the piston 18. The supporting ring 28 is movable relative to the piston carrier 29.

Figure 4:
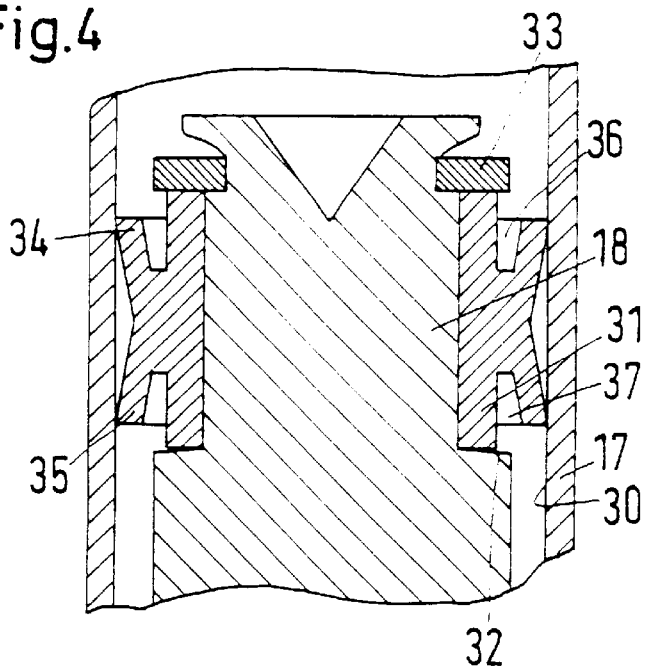
FIG. 4 shows a first construction of a piston ring arrangement.

A first practical example of the piston 18 is shown to an enlarged scale in FIG. 4, to explain the seal that is effected by means of the piston.

The radial inside of the hollow cylinder 17 forms a complementary sealing face 30, against which a piston ring 31 bears. The piston ring 31 is supported at one axial end on a step 32 on the piston 18. At the other end, it is held by a retaining washer 33, for example of stainless steel, which engages resiliently in the piston 18.

The piston ring 31 has two sealing lips 34, 35, which are preferably made of plastics material, for example, polytetrafluoroethylene (PTFE, Teflon). The sealing lips 34, 35 have an oblique sectional area. They point in both axial directions of movement of the piston 18 (seen relative to the slide member 13). They each form an annular space 36, 37 on which the pressure on that side of the piston ring 31 acts. The pressure causes the sealing lips 34, 35 to be pressed with a relatively great force against the complementary sealing face 30 and accordingly to contribute to a satisfactory seal.

Figure 5:
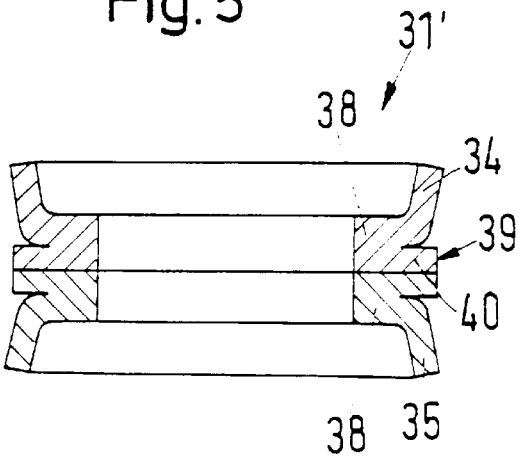
FIG. 5 shows a second construction of a piston ring arrangement.

In the illustration in FIG. 4, the piston ring 31 is of one-piece construction. FIG. 5 shows a modified embodiment, in which the piston ring is in the form of a piston ring arrangement 31' and comprises two identical lipped rings 38 that are positioned facing in opposing directions on the piston. The lipped rings 38 in this particular case have not only the sealing lips 34, but also a radial supporting surface 39. The radial supporting surface 39 is the circumferential surface of a ring 40. The two lipped rings 38 lie adjacent at their rings 40. By means of the supporting surface 39, the piston ring arrangement 31' is protected against lateral loading.

Figure 6:
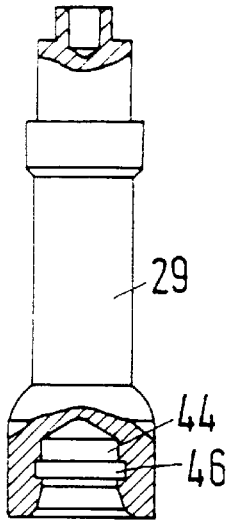
FIG. 6 shows a piston without a piston ring arrangement.
Figure 7:
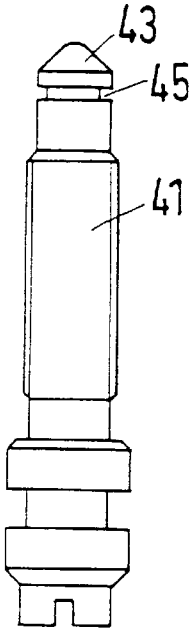
FIG. 7 shows a shaft.
Figure 8:
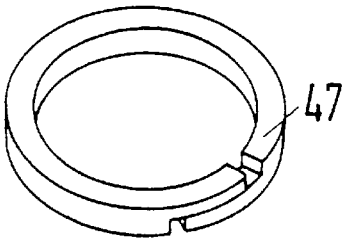
FIG. 8 shows a first alternative construction of a piston ring.
Figure 9:
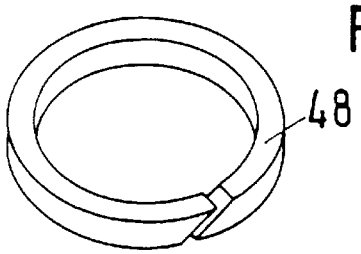
FIG. 9 shows a second alternative construction of a piston ring.

FIGS. 8 and 9 show alternatives to the piston ring. Here, the seal is in the form of a divided piston ring 47, 48. The piston ring 47, 48 is pressed downwards and against the step 32 by the incoming pressure and at the same time radially expanded. This solution is very cost-efficient. Because the slide member 13 is guided with clearance in the guide 14, the angular alignment of the slide member 13 with respect to the axis 7 can alter slightly. To ensure that the piston 18 remains aligned with respect to the slide member 13, the piston carrier 29 (FIG. 6) is mounted on a shaft 41. The shaft 41 is adjustable in the housing 5, that is, its axial position (relative to the axis 7) can be changed by turning.

The shaft 41 has a conical or rounded bearing surface 43 at its end facing the piston carrier 29. The piston carrier has a corresponding receiving opening 44 at its end facing the shaft 41, so that it is able to tilt within certain limits relative to the shaft 41. The angles of tilt are very small here, however.

To ensure axial cohesion between the shaft 41 and the piston carrier 29, the shaft 41 has an annular groove 45 below the bearing surface 43. A corresponding annular groove 46 is provided in the opening 44. A spring washer can then be inserted in the annular groove 45. As the shaft 41 is inserted in the piston carrier 29, this spring washer is compressed by an inclined surface in the entry opening of the piston carrier 29 and the spring washer then locks in the groove 46. The spring washer is not shown here. If the spring washer has a small axial clearance in at least one of the two annular grooves 45, 46, then this connection gives the mobility for tilting. On the other hand, it is capable of absorbing not only compressive forces, but also tensile forces. Such tensile forces could occur, for example, when the pressure from the second port 3 passes beneath the piston carrier 29.

Figure 10:
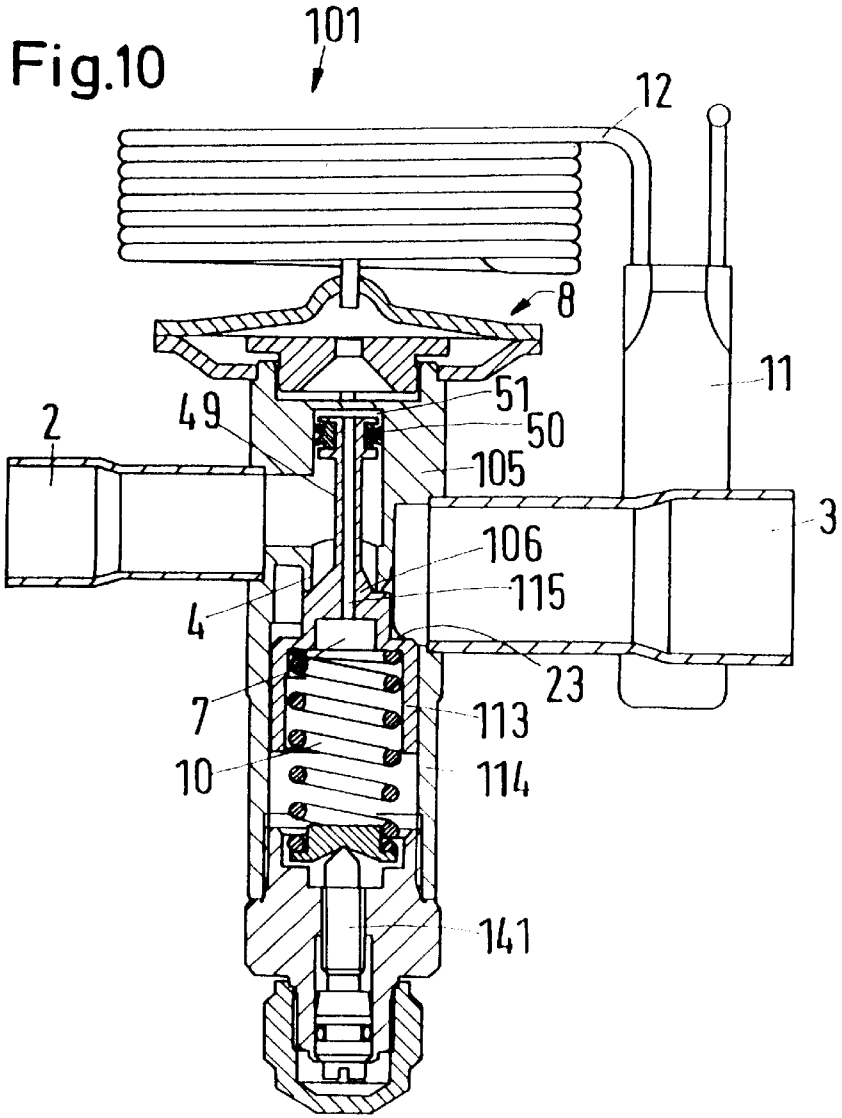
FIG. 10 shows a second construction of an expansion valve.

FIG. 10 shows a further practical example of an expansion valve 101. Parts identical with parts in FIG. 1 have been given the same reference numbers. Corresponding parts have been given reference numbers increased by 100.

The equilibrium of forces on the slide member 113, which is similarly guided with clearance in the guide 114, is achieved in a different manner in this construction.

The slide member 113 is connected by means of a rod 49 to a piston 50, which is arranged in a cylinder 51 in the housing 105 coaxially with respect to the axis 7. The piston 50 can be sealed with respect to the cylinder 51 in the same manner as illustrated in FIGS. 4 and 5. Both the piston 50 and the rod 49 have a channel 115 passing through them. The slide member 113 is downwardly open, that is, open on the side remote from the valve seat 4.

In this practical example, the pressure in the first port 2 acts on the valve element 106 in the region that is not covered by the valve seat 4. The piston 50 has a cross-sectional area of the same size. The pressure in the first port 2 therefore also acts on the piston 50, but here in the opposite direction. With regard to the pressure in the first port 2, the slide member 113 is in force equilibrium with the piston 50.

The pressure in the second port 3 acts on the one hand on the annular surface 23 outside the valve seat 4. Since this pressure is able to propagate past the slide member 113 onto the underside of the slide member 113, it acts in the opposite direction on the entire cross-sectional area of the slide member 113. It nevertheless propagates also through the channel 115 to the top side of the piston 50, so that the pressure in the second port 3 also acts downwards across the entire cross-sectional area (area of the piston 50+annular surface 23). The slide member 113 is accordingly also in equilibrium in respect of pressure in the second port 3.

The restoring spring 10 is (because of the ability of the slide member 113 to tilt) pivotally supported on the shaft 141. The tension of the restoring spring 10 can change accordingly.

Figure 11:
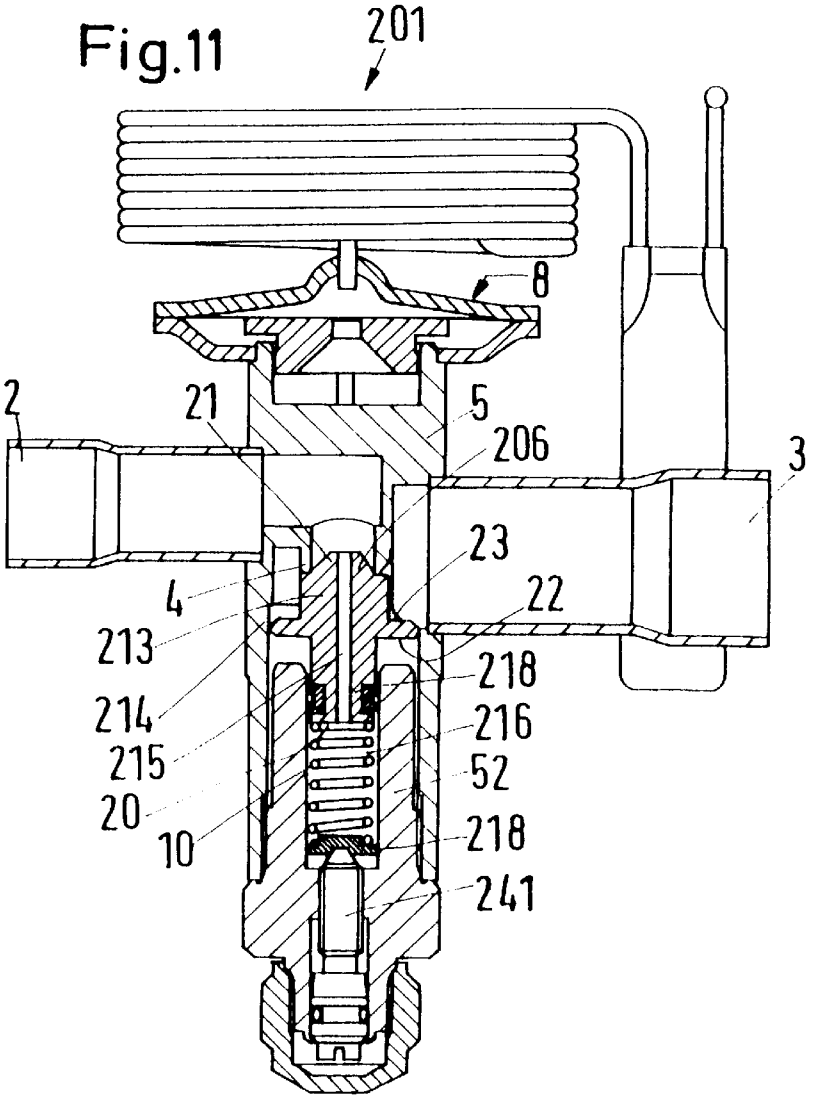
FIG. 11 shows a third construction of an expansion valve.

FIG. 11 shows a third practical example of an expansion valve 201, in which parts identical with parts in FIG. 1 have been given the same reference numbers and corresponding parts have been given reference numbers increased by 200.

The construction of the housing 5 corresponds to that of FIG. 1.

The slide member 213 is guided with clearance in the guide 214. An insert part 52, which encloses the pressure chamber 216, is screwed into this guide 214, however. The restoring spring 10 is arranged in the pressure chamber 216, in fact so that here too it is adjustable by a shaft 241 that carries a supporting ring 218.

The channel 215 passes through the length of the slide member 213. The slide member 213 projects with its lower end in the form of a piston 218 into the insert part 52. The piston 218 can be sealed with respect to the insert part 52 in the same way as illustrated in FIGS. 4 and 5.

In this construction, the pressure from the first port 2 is able to act on the one hand on a surface 21 of the valve element 206 that is not covered by the valve seat 4. The pressure is able to propagate through the channel 215 to the opposite end face of the slide member 213. There, a surface

20 of the same size is available, so that the slide member 213 is in equilibrium with respect to the pressure in the first port 2.

The pressure in the second port 3 is able to advance past the slide member 213 to the underside 22, which beyond the piston. On the upper side 23, which is the same size, the pressure in the second port 3 acts in the opposite direction. Accordingly, the slide member 213 is also in equilibrium with respect to the pressure in the second port 3.

In all practical examples the path leading past the slide member can be formed other than by a guide providing clearance. The slide member can also be flattened on one side or at several points or be provided with axial grooves. The guide can, of course, also be provided with corresponding recesses.

The equilibrium condition applies not only, as explained, in the closed state of the expansion valve. When the valve element lifts away from the valve seat, then other pressures obtain at the relevant surfaces 20–23, but at the surfaces acting in opposite directions these pressures are again virtually of identical magnitude, so that even with the valve open there is an equilibrium in respect of forces.

What is claimed is:

1. An expansion valve having a valve element, which valve element co-operates with a valve seat arranged between a first port and a second port in a housing, the valve element being movable by an operating device in one direction and by a restoring device in an opposite direction along a same axis relative to the valve seat, the valve element being connected to a first pressure surface arrangement comprising first pressure surfaces of substantially equal size acting in opposite directions on which pressure in the first port acts when the valve is closed, and to a second pressure surface arrangement comprising second pressure surfaces of substantially equal size acting in opposite directions on which the pressure in the second port acts when the valve is closed.

2. An expansion valve according to claim 1, in which the valve element is connected to a slide member that is guided parallel to the axis.

3. An expansion valve according to claim 1, in which the first pressure surface arrangement and the second pressure surface arrangement are separated from one another by a piston guided in a sealed manner, wherein, on movement of the valve element, a relative movement between the piston and a complementary sealing face is effected.

4. An expansion valve according to claim 3, in which the slide member has no seal relative to the valve housing.

5. An expansion valve according to claim 4, in which the slide member is guided with clearance in the housing.

6. An expansion valve according to claim 3, in which the piston has secured to it a seal, which lies against the complementary sealing face.

7. An expansion valve according to claim 6, in which the seal is a piston ring arrangement.

8. An expansion valve according to claim 7, in which the piston ring arrangement has at least one radially outwardly pre-tensioned sealing lip.

9. An expansion valve according to claim 8, in which the piston ring arrangement has two oppositely directed sealing lips.

10. An expansion valve according to claim 9, in which the sealing lips are arranged on two lipped rings that are identical but installed with a different direction.

11. An expansion valve according to claim 10, in which the lipped rings have radial supporting surfaces.

12. An expansion valve according to claim 11, in which the supporting surfaces are formed on rings, on the end faces of which the lipped rings lie superimposed on one another.

13. An expansion valve according to claim 9, in which together with the piston the sealing lips form annular pockets, which are open in the direction of movement.

14. An expansion valve according to claim 7, in which the piston ring arrangement is supported by a retaining disc.

15. An expansion valve according to claim 7, in which the piston ring arrangement comprises a piston ring divided circumferentially.

16. An expansion valve according to claim 15, in which the piston ring is expandible radially under pressure.

17. An expansion valve according to claim 2, in which the slide member is guided in the housing so as to form a pressure equalization path which connects to the second port.

18. An expansion valve according to claim 2, in which the piston is fixedly located in the housing and projects into the slide member, the piston defining in the slide member a pressure chamber which connects with the first port when the valve is closed.

19. An expansion valve according to claim 18, in which the piston is supported by an articulation surface arrangement against a shaft.

20. An expansion valve according to claim 19, in which the piston with the shaft comprises a connection able to absorb tensile and compressive forces.

21. An expansion valve according to claim 20, in which the connection is formed by a spring washer, which is inserted in an annular space enclosed by a first annular groove on the piston and a second annular groove on the shaft.

22. An expansion valve according to claim 18, in which the slide member comprises a cup-shaped bowl having a closed end including the valve element.

23. An expansion valve according to claim 22, including a hollow cylinder, that together with the piston bounds the pressure chamber, the hollow cylinder being inserted in the bowl.

24. An expansion valve according to claim 23, in which the outer wall of the hollow cylinder and the inner wall of the bowl form an annular space, in which a restoring spring is arranged.

25. An expansion valve according to claim 2, in which the piston is arranged on the slide member and has a channel passing through it parallel to the direction of movement.

26. An expansion valve according to claim 25, in which the piston is arranged on the other side of the valve seat from the slide member and is connected with the slide member by means of a rod.

27. An expansion valve according to claim 2, in which the piston is arranged on the same side of the valve seat as the slide member and in a guide built into the housing.

28. An expansion valve according to claim 2, in which the valve element is formed in one piece with the slide member.

* * * * *

UNITED STATES PATENT AND TRADEMARK OFFICE

CERTIFICATE OF CORRECTION

PATENT NO. : 6,116,574
DATED : September 12, 2000
INVENTOR(S) : Hans Kurt Petersen It is certified that error appears in the above-identified patent and that said Letters Patent is hereby corrected as shown below:

On the title page, item [73] Assignee, should read:

-- Danfoss A/S, Denmark, Germany --.

Signed and Sealed this

Eighth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,116,574
DATED : September 12, 2000
INVENTOR(S) : Hans Kurt Petersen It is certified that error appears in the above-identified patent and that said Letters Patent is hereby corrected as shown below:

Title page,
Item [73] Assignee, should read as follows -- Danfoss A/S, Nordborg, Denmark --.

Signed and Sealed this

Second Day of October, 2001

*Attest:*

Nicholas P. Godici

NICHOLAS P. GODICI
*Acting Director of the United States Patent and Trademark Office*

*Attesting Officer*